US008286649B2

(12) United States Patent
Gueret

(10) Patent No.: US 8,286,649 B2
(45) Date of Patent: Oct. 16, 2012

(54) APPLICATOR AND A PACKAGING AND APPLICATOR DEVICE INCLUDING SUCH AN APPLICATOR

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1395 days.

(21) Appl. No.: 11/488,690

(22) Filed: Jul. 19, 2006

(65) Prior Publication Data

US 2007/0017544 A1 Jan. 25, 2007

Related U.S. Application Data

(60) Provisional application No. 60/707,984, filed on Aug. 15, 2005.

(30) Foreign Application Priority Data

Jul. 19, 2005 (FR) ..... 05 52246

(51) Int. Cl.
*A45D 40/26* (2006.01)

(52) U.S. Cl. ..... 132/320

(58) Field of Classification Search ..... 132/320, 132/317, 318; 401/127, 126, 129, 130
See application file for complete search history.

(56) References Cited

U.S. PATENT DOCUMENTS

| | | | | |
|---|---|---|---|---|
| 4,666,709 | A | 5/1987 | Jankewitz | |
| 5,816,270 | A | 10/1998 | Nadel | |
| 5,881,743 | A | 3/1999 | Nadel | |
| 6,070,598 | A | 6/2000 | Gueret | |
| 6,220,254 | B1 | 4/2001 | Gueret | |
| 6,280,112 | B1 * | 8/2001 | Vieu | 401/122 |
| 2004/0018037 | A1 * | 1/2004 | Gueret | 401/126 |

FOREIGN PATENT DOCUMENTS

| | | |
|---|---|---|
| EP | 1 053 695 | 11/2000 |

* cited by examiner

*Primary Examiner* — Rachel Steitz
(74) *Attorney, Agent, or Firm* — Oliff & Berridge, PLC

(57) ABSTRACT

An applicator for applying a composition to a surface may include at least one applicator endpiece including at least a body of non-porous material that is covered, at least in part, by flocking. The body may include a proximal first portion, a distal second portion connected to the first portion and comprising at least one application face; and at least one hinge-forming zone between the first portion and the second portion. The hinge-forming zone may enable the second portion to pivot relative to the first portion while the application face is pressing against the surface.

37 Claims, 4 Drawing Sheets

APPLICATOR AND A PACKAGING AND APPLICATOR DEVICE INCLUDING SUCH AN APPLICATOR

This non-provisional application claims the benefit of French Application No. 05 52246 filed on Jul. 19, 2005 and U.S. Provisional Application No. 60/707,984 filed on Aug. 15, 2005, the entire disclosures of which are incorporated herein by reference.

The present invention relates to an applicator comprising a stem that is provided at one end with an applicator endpiece for applying a composition to a surface such as skin, lips, or nails. The present invention also relates to a packaging and applicator device including such an applicator.

BACKGROUND

U.S. Pat. No. 6,070,598 discloses applicator endpieces of generally cylindrical shape and including a chamfered end. Such endpieces enable a composition to be applied to a surface in a relatively accurate manner.

U.S. Pat. No. 6,220,254 discloses endpieces for applying makeup to lips. The endpieces are used in connection with a wiper member constituted by a block of foam. The use of such a wiper member makes it possible to use applicator endpieces with a wide variety of shapes.

European application EP-A-1 053 695 discloses endpieces that deform on passing through a wiper member.

U.S. Pat. No. 5,881,743 relates to a makeup applicator comprising a body made of deformable material and including an applicator portion that defines a planar application surface. The applicator portion includes a recess disposed between the planar application surface and a handle portion of the applicator. Only the applicator portion of the first end of the deformable body is used for application.

In addition, the applicator portion has a width measured perpendicularly to the longitudinal axis of the applicator that is greater than the width of the handle portion.

SUMMARY

Endpieces such as those disclosed in U.S. Pat. No. 6,070,598 make it possible to apply only a relatively small quantity of composition, given that the endpieces are wiped thoroughly as a result of their cylindrical shape, and given the small area of the chamfered end that is used for application. In addition, such endpieces may be relatively rigid and may expel the composition that is on the chamfered surface in such a manner that the composition is spread in an uneven manner on the surface. Further, the comfort in application may not be completely satisfactory. Finally, the inclination of the chamfer, which conditions the inclination of the applicator during use, complicates application.

Endpieces such as those disclosed in U.S. Pat. No. 6,220,254 may be costly and bulky.

A drawback of applicator endpieces such as those disclosed in European application EP-A-1 053 695 is the endpieces are likely to retain a relatively large quantity of composition, possibly making it difficult to apply the composition accurately, or to deposit the composition in a thin layer.

There exists a need to for an applicator that makes it possible to apply composition in a relatively thin layer, if so desired by the user, while being comfortable in application, and accurate.

Exemplary embodiments of the invention may provide an applicator for applying a composition to a surface, such as skin, lips, or nails. The applicator may comprise an applicator endpiece comprising at least a body, for example, made of a non-porous material. The body may comprise: a proximal first portion; a distal second portion connected to the first portion and including at least one application face; and at least one hinge-forming zone between the first portion and the second portion, the hinge-forming zone being configured to enable the second portion to pivot relative to the first portion while the application face is pressing against the surface.

The body may be covered completely by flocking. The proximal first portion may be flocked at least in part. The hinge-forming zone may be flocked.

As a function of a force with which the user presses the application face against the surface, the second portion may pivot to a greater or lesser extent relative to the first portion. If desired, the user may thus modify an extent of the application face that is in contact with the surface. Furthermore, the pressure exerted on the surface by the applicator endpiece may be reduced. For example, the user may feel a spring effect. When the pressure exerted by the user stops, the applicator endpiece may return to an initial shape thereof.

In exemplary embodiments, positioning the hinge-forming zone between a proximal first portion and a distal second portion may make it possible to impart flexibility to the applicator endpiece, for example, at the distal end, thereby making it easier to outline and to apply the composition, for example, to draw an outline of the lips.

Exemplary embodiments of the invention may enable the applicator to be made with an application face that extends obliquely relative to a longitudinal axis of the stem, while ensuring that the application face may come into contact with the surface to be made-up or to be treated, without including to comply with some particular angle of inclination, given that the second portion may pivot relative to the first portion. The composition may thus be applied more quickly, for example, without any increased awkwardness or reduction in quality with which the makeup is applied.

Exemplary embodiments of the invention may enable the composition to be applied more accurately.

Exemplary embodiments of the invention may make it possible to apply a thin layer of composition, or to superpose a plurality of layers of composition, for example, to reinforce durability of the composition on the surface and/or shine of the applied composition, thereby improving the quality of the makeup.

In exemplary embodiments, the proximal first portion of the body of the applicator endpiece may include at least one application face. The application face may extend over the proximal first portion and over the distal second portion. The proximal first portion may be used for application, as may the distal second portion.

The applicator portion may extend, at least in part, between the hinge-forming zone and an end of the applicator endpiece that is fastened or secured to a remainder of the applicator.

In exemplary embodiments, the second portion may pivot relative to the first portion substantially about a pivot axis that is perpendicular to a longitudinal axis of the applicator. The applicator endpiece may extend generally along a longitudinal axis that forms a non-zero angle with the longitudinal axis of the applicator or of the stem. The longitudinal axis of the applicator or the stem and the longitudinal axis of the applicator endpiece may define a plane that is substantially perpendicular to the pivot axis between the first and second portions.

The body of the endpiece may include at least one recess, or even two recesses. Such two recesses may be situated on one side of the body. In exemplary embodiments, the two recesses may be situated on two opposite sides of the body.

The two recesses may together define a single hinge-forming zone, or, in exemplary embodiments, each of the recesses may define a respective hinge-forming zone.

At least one recess may open to two opposite lateral sides of the body. The recess may be annular, extending over an entire circumference of the body. Preferably, the body may not be circularly symmetrical.

In longitudinal cross-section in a plane containing the longitudinal axis of the applicator, the recess may include a profile that is generally triangular or crenellated.

The second portion may include an opening, for example, a slot, that enables the composition contained in the recess to flow more easily to the application face.

The hinge-forming zone may include a cross-section of shape selected from: circular, oval, elliptical, polygonal, for example, square, triangular, rectangular, pentagonal, hexagonal, and trapezoidal, amongst others. The hinge-forming zone may include a cross-section of flat shape. The shape of the cross-section of the hinge-forming zone may vary along the longitudinal axis of the applicator. Depending on its shape in cross-section, the hinge-forming zone may define at least one pivot axis about which the second portion tends to pivot during application, under normal conditions of use.

In exemplary embodiments, the applicator endpiece may be configured so that, in use, the pivot axis is substantially parallel to the surface onto which the composition is being applied.

The hinge-forming zone may include shape memory. The term "including shape memory" should be understood as meaning that the hinge-forming zone returns to an initial shape thereof after use.

The hinge-forming zone may include a cross-section that is inscribed in a largest cross-section of at least one of the first portion and the second portion. A smallest cross-section of the pivot zone may be less than or equal to 2 square millimeters ($mm^2$), for example.

At least one of the first and second portions may include a cross-section of shape selected from: circular, oval, elliptical, polygonal, for example, square, triangular, rectangular, pentagonal, hexagonal, and trapezoidal. At least one of the first and second portions may optionally be truncated.

In exemplary embodiments, the first portion may include a cross-section that is substantially circular over at least a fraction of a length thereof. The second portion may include a cross-section that is not circular over at least a fraction of a length thereof. For example, the cross-section of the second portion may be flat parallel to a pivot axis between the first and second portions.

In exemplary embodiments, the body of the applicator endpiece may be non-compressible and/or non-absorbent.

The term "non-porous" does not exclude the fact that the body may be flocked.

The body of the applicator endpiece may be covered, at least in part, or even completely, by flocking and/or by a porous material, for example, foam, that is heat-sealed or bonded on a more rigid body. Alternatively, in contrast, the body need not be covered by any flocking or by any porous material. The first portion may be covered by flocking. When the body of the endpiece is covered by foam, the foam need not include a recess. In exemplary embodiments, the body may include an outer surface that defines the application face. For example, the body may be other than a sintered piece.

The body of the applicator endpiece may be molded, at least in part, and preferably completely, for example, by injection-molding, of a material selected, for example, from: thermoplastic materials; elastomers; thermoplastic elastomers; thermoplastic elastomer polyester, such as Hytrel®, for example; nitrile rubber; silicone; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene (PET); and polypropylene (PP). The body of the applicator endpiece may be made, at least in part, from a material that is more flexible than a material from which the stem is made.

In exemplary embodiments, the applicator endpiece may be magnetic. For example, the applicator endpiece may contain particles including a non-zero magnetic susceptibility.

The applicator may comprise a stem including an end, the first portion of the applicator endpiece being fastened to the end of the stem.

The applicator may comprise a stem that extends along a longitudinal axis. A greatest width of the applicator endpiece measured perpendicularly to the longitudinal axis of the stem may be less, or even strictly less, than a greatest width of the stem measured perpendicularly to the longitudinal axis of the stem.

The body of the applicator endpiece may be made by injection-molding. The body of the applicator endpiece may be molded integrally, that is, monolithically, with a fastener portion, for example, for inserting into the stem. The applicator endpiece may be fastened to the stem by injection-molding onto the stem, by adhesive, by heat-sealing, by force-fitting, by snap-fastening, by clamping, or by screw-fastening.

The stem may include a flexible zone that may make it easier to deform, although the stem need not include such a flexible zone.

The applicator may include a handle that is fastened to an end of the stem that is remote from the endpiece.

The handle may include at least one reception zone configured to receive a finger, for example, a cavity or a flat, that may extend substantially parallel to the pivot axis between the first and second portions.

The applicator may be loaded with composition by dipping the applicator endpiece into a receptacle. The receptacle may advantageously include a wiper member that includes a substantially circular orifice, for example, defined by a wiper lip.

In exemplary embodiments, the first portion may be fastened to a receptacle containing the composition. The receptacle may serve as a handle for the applicator. In use, the applicator endpiece may thus be loaded with composition from the receptacle that is secured to the applicator.

Regardless of how the applicator is loaded with composition, the applicator may comprise a reserve of composition and a channel that is configured to enable the composition to flow from the reserve of composition to the applicator face. The channel may pass through the endpiece, for example.

Independently and in combination with the above, exemplary embodiments of the invention may provide an applicator for applying a composition to a surface, such as skin, lips, or nails, comprising an applicator endpiece comprising at least a body, for example, injection-molded of a plastics material. The body may comprise: a proximal first portion; a distal second portion connected to the first portion and including at least one application face; and at least one hinge-forming zone between the first portion and the second portion, that is configured to enable the second portion to pivot relative to the first portion while the application face is pressing against the surface.

Exemplary embodiments of the invention may provide a packaging and applicator device for applying a composition to a surface, such as skin, lips, or nails, comprising: a receptacle containing the composition for application; and an applicator as defined above.

The device may further comprise a wiper member configured to wipe the applicator, for example, when the applicator is loaded with composition by being dipped into the receptacle. The wiper member may include a flexible lip. The flexible lip may be made of a material that does not include cells. The wiper member may thus be different from the wiper member made of a foam. The wiper member may include a wiper orifice, for example, a circular orifice. A smallest inside diameter of the wiper member may be substantially equal to a greatest outside diameter of the applicator endpiece, for example, of the first portion.

The receptacle may advantageously be closed in a leaktight manner when not in use.

The composition may be a cosmetic, a skin care product, makeup, or a care product. The composition may be a composition for the lips, for example, a lipstick or a lip care product. The composition may also be makeup or a care product that is not for the lips, for example, an eyeshadow, a nail varnish, or an eyeliner.

Independently or in combination with the above, exemplary embodiments of the invention may provide a packaging and applicator device for applying a composition to a surface, such as skin, lips, or nails, comprising: a receptacle containing the composition; and an applicator comprising at least one applicator endpiece comprising at least a body. The body may comprise: a proximal first portion; a distal second portion connected to the first portion and including at least one application face; and at least one hinge-forming zone between the first portion and the second portion, that enables the second portion to pivot relative to the first portion while the application face is pressing against the surface; and a wiper member configured to wipe the applicator.

Exemplary embodiments of the invention may provide a method of applying makeup to a surface, for example, to lips, wherein a layer of composition is deposited on the surface by an applicator endpiece comprising a body, for example, made of non-porous material, and comprising: a proximal first portion; a distal second portion connected to the first portion and including at least one application face; and at least one hinge-forming zone between the first portion and the second portion. In exemplary embodiments, pressure exerted on the surface may be sufficient to cause the second portion to pivot relative to the first.

In exemplary embodiments, the made-up surface may comprise at least one lip of the user.

BRIEF DESCRIPTION OF THE DRAWINGS

Various details of the present invention may will be better understood on reading the following detailed description of non-limiting embodiments, and on examining the accompanying drawings, in which.

DETAILED DESCRIPTION OF EMBODIMENTS

Figure 1:
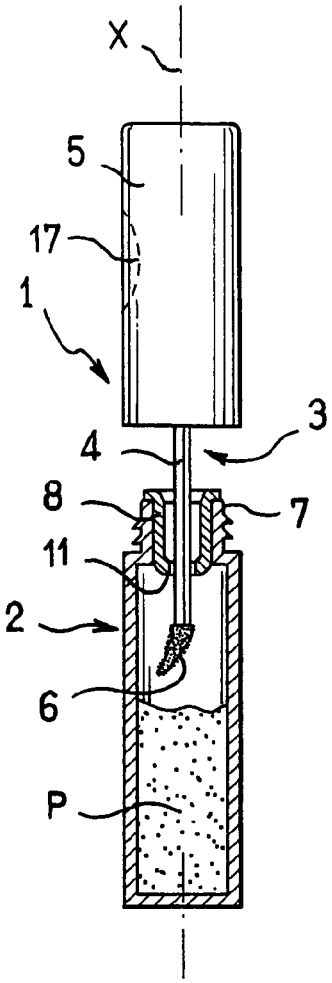
FIG. 1 is a fragmentary longitudinal cross-sectional view of an exemplary device.

FIG. 1 illustrates an exemplary packaging and applicator device 1 comprising a receptacle 2 and an applicator 3. The receptacle 2 may contain a composition, for example, a lipstick as illustrated. It is contemplated that the composition P may be something else, for example, a lip care product, an eyeshadow, an eyeliner, or a nail varnish.

Figure 2:
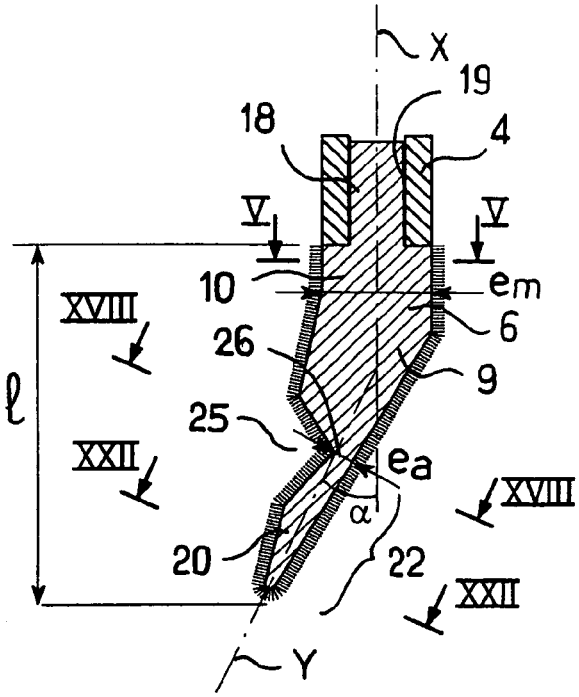
FIG. 2 is a fragmentary longitudinal cross-sectional view of the applicator of FIG. 1.

The applicator 3 may comprise a stem 4 that carries at a proximal end thereof a handle 5, and at a distal end thereof an applicator endpiece 6, for example, as illustrated in greater detail in FIG. 2.

The handle 5 may comprise a closure cap configured to close the receptacle 2, and may include an internally-threaded skirt so as to be screwed onto a neck 7 of the receptacle 2, which itself may include a corresponding outside thread.

The device 1 may further comprise a wiper member 8 that bears against the neck 7 of the receptacle 2, and that contributes to closing the receptacle in a leaktight manner.

In exemplary embodiments, the stem 4 may include a circular cross-section. It is contemplated, however, that this may be otherwise. For example, the cross-section of the stem 4 may be oval, elliptical, or polygonal, for example, square, rectangular, or triangular. The stem may be solid or hollow. A greatest outside diameter of the stem may be about 5 millimeters (mm), for example. When the stem is not circular in cross-section, the cap 5 may possibly be fastened by snap-fastening, without turning relative to the receptacle. The wiper member 8 may be configured to include an orifice of cross-section that is complementary to the cross-section of the stem.

The wiper member 8 may include a lip that is configured to wipe the applicator, and that is preferably made of a material that does not include cells.

Figure 22:
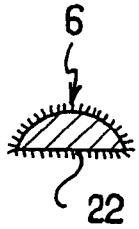
FIG. 22 is a cross-sectional view taken along XXII-XXII at the second portion of the applicator endpiece in FIG. 2.

The applicator endpiece 6 may include a body 9 made of non-porous material, for example, made of an injected plastics material, and covered by flocking. The body 9 may include a proximal first portion 10 that is fastened to the stem 4, and a distal second portion 20 that is connected to the first portion 10, and that defines at least one application face 22 that is substantially planar, for example, as illustrated in FIG. 22.

As illustrated in FIG. 2, the body of the applicator endpiece 6 may further include at least one recess 25 that opens to a side remote from the application face 22, and that defines a hinge-forming zone 26 between the first portion 10 and the second portion 20. The hinge-forming zone may comprise a thin zone, for example, that enables the second portion 20 to pivot relative to the first portion 10 while the application face 22 is pressing against the surface onto which the composition is to be applied.

A smallest inside diameter of the wiper member 8 defined by an edge of the lip 11 may be substantially equal to a greatest outside diameter of the first portion 10, for example.

As illustrated in FIG. 2, the applicator endpiece 6 may extend generally along a longitudinal axis Y that slopes by a non-zero angle α relative to the longitudinal axis X of the stem 4.

In use, the second portion 20 may pivot relative to the first portion 10 substantially about a pivot axis that is perpendicular to the longitudinal axis X of the applicator. The axes X and Y may define a plane that is substantially perpendicular to the pivot axis between the first and second portions 10, 20.

When the angle α is zero at rest, the longitudinal axes X and Y may coincide, as illustrated in FIGS. 10 to 17.

The handle 5 may include at least one reception zone configured to receive a finger, for example, a cavity 17, illustrated by dashed lines in FIG. 1, and including a bottom wall that extends substantially parallel to the pivot axis between the first and second portions 10, 20. In exemplary embodiments not shown, the cavity may be replaced by a flat.

The body of the applicator endpiece 6 may include an end portion 18 configured to be fastened in a housing 19 provided at the distal end of the stem 4. It is contemplated that the body of the applicator endpiece may be fastened to the stem by other means, for example, by injection-molding on the stem, or even by adhesive, by heat-sealing, by snap-fastening, by clamping, or by screw-fastening.

The above-described device may be used as follows.

Figure 4:
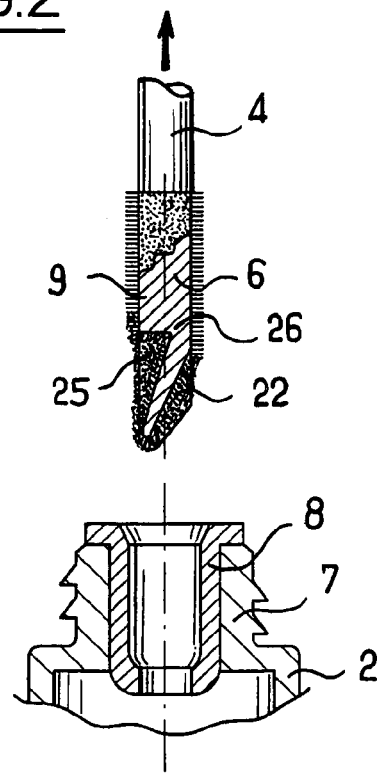
FIG. 4 illustrates the applicator of the device of FIG. 1 being removed from the receptacle.

The user may load the applicator endpiece 6 with composition by dipping the endpiece 6 into the receptacle 2, then removing the endpiece 6, passing through the wiper member 8, as illustrated in FIG. 4. Some composition P may remain in the recess 25 and on the application face 22.

The applicator endpiece 6 may optionally deform while passing through the wiper member. For example, the second portion 20 may optionally deform as a function of its nature, and of its angle of inclination relative to the longitudinal axis of the applicator.

Figure 3:
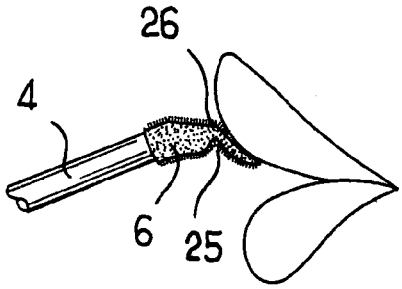
FIG. 3 illustrates use of the applicator of FIGS. 1 and 2.

The user may press the application face 22 against the surface to be made-up, for example, the lips, in such a manner as to cause the second portion 20 to pivot relative to the first portion 10, as illustrated in FIG. 3. For example, a degree of pivoting may be greater than 15°, or even greater than 20°.

During application, the first portion 10 may preferably deform little or substantially not at all. The second portion 20 may pivot relative to an initial position thereof, without the first portion 10 changing direction significantly.

Application may thus be performed in an even and accurate manner, in a single thin layer, or in a plurality of passes.

Only the application face 22 need be pressed against the surface. However, in exemplary embodiments, the user may also use a remainder of the surface of the applicator endpiece to apply the composition, and, for example, may use the face of the second portion remote from the application face 22.

Figure 5:
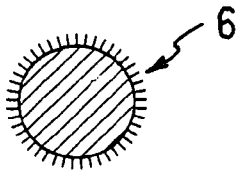
FIG. 5 is a cross-sectional view taken along V-V of the applicator endpiece in FIG. 2.
Figure 6:
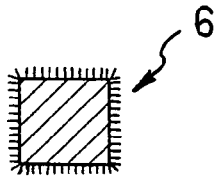
FIGS. 6 to 9 are views similar to FIG. 5 of various exemplary embodiments.
Figure 7:
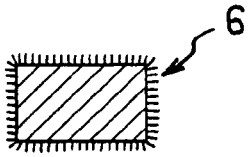
Figure 8:
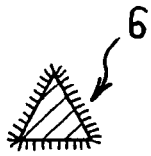
Figure 9:
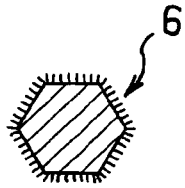

In exemplary embodiments, the first portion 10 of the body 9 of the applicator endpiece 6 may be of circular cross-section over at least a fraction of a length thereof, as illustrated in FIG. 5. However, it is contemplated that this may be otherwise. For example, over at least a fraction of its length, the cross-section of the first portion 10 may, for example, be oval, elliptical, or even polygonal, for example, square, as illustrated in FIG. 6, rectangular, as illustrated in FIG. 7, triangular, as illustrated in FIG. 8, or even hexagonal, as illustrated in FIG. 9, these examples not being limiting.

When the cross-section of the first portion is oblong, being elongate along a major axis, that is, the long axis, the cross-section of the applicator endpiece at the hinge-forming zone may, for example, be elongate along the same major axis, thereby enabling the second portion to pivot while remaining in a plane that is perpendicular to the major axis, with application thus being more accurate, for example.

In exemplary embodiments, the hinge-forming zone may include a non-circular cross-section that is off-center relative to the longitudinal axis of the applicator.

As illustrated in FIG. 2, the body 9 of the applicator endpiece 6 may be truncated along a chamfer that is substantially parallel to the axis Y. For example, the first portion, over a fraction of a length thereof, and the second portion, over its entire length, may be of truncated circular cross-section, as illustrated in FIGS. 18 and 22.

Figure 18:
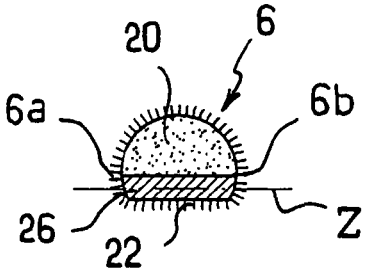
FIGS. 18 to 21 are cross-sectional views at the recess of various exemplary applicator endpieces.

The cross-section of the second portion 20 may be circular or of some other shape, for example, being flat of major axis parallel to the pivot axis Z, as illustrated in FIGS. 18 and 22.

As illustrated in FIG. 2, the cross-section of the body 9 of the applicator endpiece 6 at the hinge-forming zone 26 may be inscribed in a largest cross-section of the first portion, as illustrated in FIG. 18.

The recess 25 may open to two opposite lateral sides 6*a* and 6*b* of the body 9 of the applicator endpiece. For example, the thickness $e_a$ of the body 9 of the applicator endpiece at the hinge-forming zone 26 may be less than half a maximum thickness $e_m$ of the first portion, the thickness being measured in the plane of FIG. 2, that is, a plane in which the recess profile is greatest.

For example, a greatest dimension in cross-section of the body of the endpiece may be less than 7 mm.

For example, the visible length l of the body of the applicator endpiece that projects from the stem or from the reserve of composition may lie in a range of about 5 mm to about 20 mm. For example, the length of the second portion may lie in a range of about one-fourth to about three-fourths of the length of the first portion.

For example, the first and second portions, and the hinge-forming zone, together with the fastener endpiece, may all be made as a single part, for example, molded as a single piece.

Figure 19:
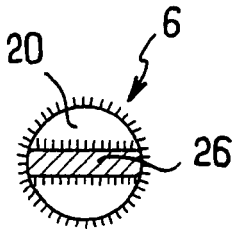
Figure 20:
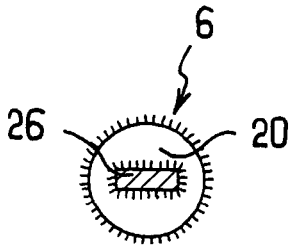
Figure 21:
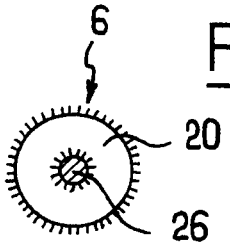

The hinge-forming zone 26 may be of various shapes in cross-section, as illustrated in FIGS. 19 to 21.

As illustrated in FIG. 18, the hinge-forming zone 26 may extend adjacent to the application face 22.

As illustrated in FIG. 19, the hinge-forming zone 26 may be situated between two recesses and may extend over substantially an entire width of the body of the applicator endpiece.

As illustrated in FIG. 20, the hinge-forming zone 26 may also be situated between two recesses, but may extend set back from lateral sides of the body of the applicator endpiece.

In exemplary embodiments, such as illustrated in FIGS. 18 to 20, the hinge-forming zone 26 may include a cross-section that is generally flat in shape, of major axis parallel to the pivot axis Z.

The exemplary embodiment in FIG. 21 differs from the exemplary embodiment in FIG. 20 by the fact that the hinge-forming zone may include a cross-section that is substantially circular in shape, thereby enabling the second portion 20 to pivot in omnidirectional manner.

Figure 10:
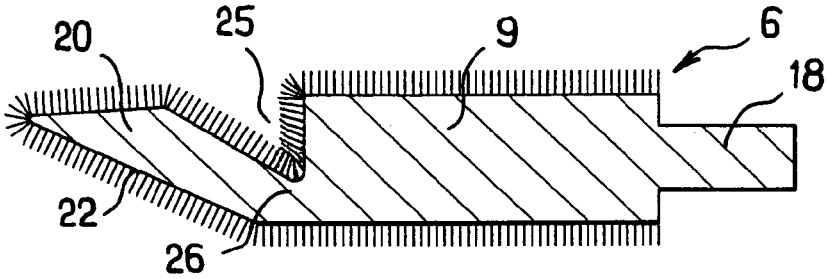
FIGS. 10 to 17 are longitudinal cross-sectional views of various exemplary applicator endpieces.

In exemplary embodiments, with reference to FIG. 2, for example, the applicator endpiece 6 may extend along a longitudinal axis Y that forms a non-zero angle α with the longitudinal axis X of the stem. However, it is contemplated that the angle α may be zero, as illustrated in FIG. 10. As illustrated in FIG. 10, the second portion 20 may include a thickness that increases and then decreases toward a free end of the body of the endpiece. This may be otherwise, and the thickness may decrease toward the free end, as illustrated in FIG. 11, or may be substantially constant and then decrease, as illustrated in FIG. 12.

Figure 11:
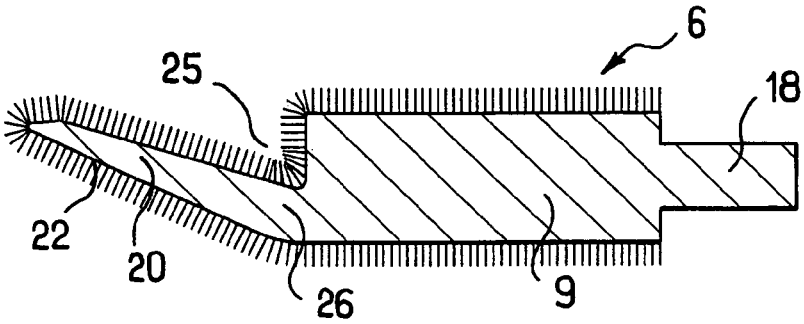
Figure 12:
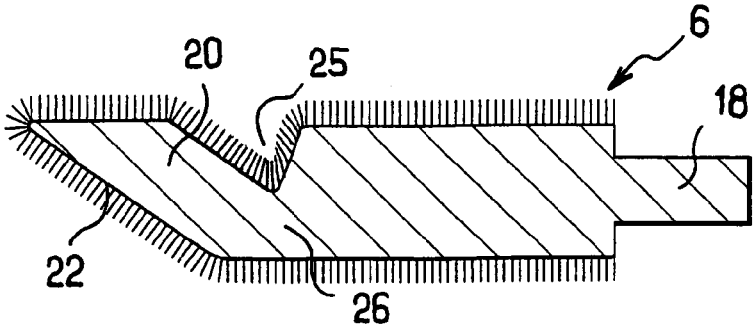

As illustrated in FIGS. 10 to 12, the recess 25 may include a generally triangular profile in longitudinal cross-section.

It is contemplated that this may be otherwise. For example, the recess may include a chamfered profile, as illustrated in FIG. 16.

Figure 14:
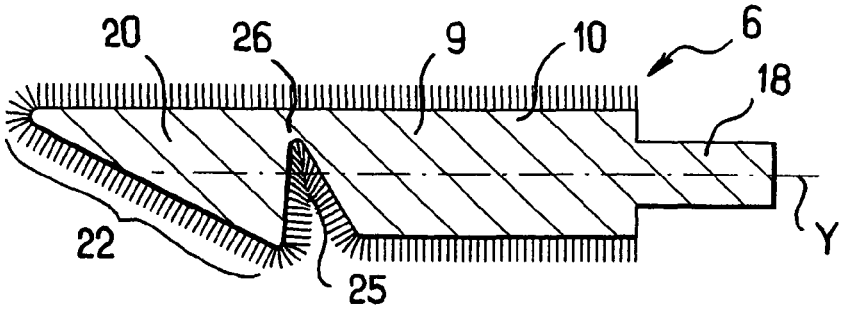

The application face 22 may be disposed on a same side as the recess 25, as illustrated in FIG. 14.

Figure 15:
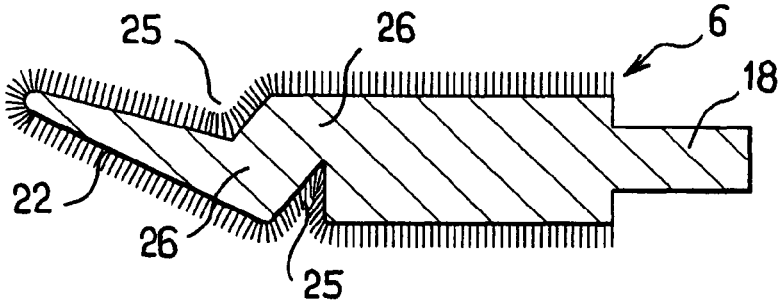
Figure 16:
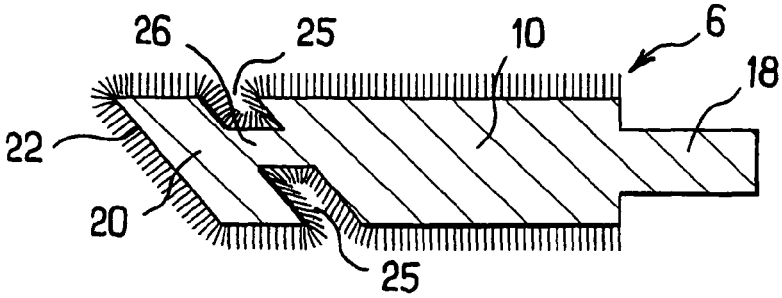

The body of the applicator endpiece may include a single recess 25, or two recesses, each defining a respective hinge-forming zone 26, as illustrated in FIG. 15, or together defining a single hinge-forming zone 26, as illustrated in FIG. 16. In exemplary embodiments, the recess may be a single annular recess, as illustrated in FIGS. 20 and 21, for example.

Figure 13:
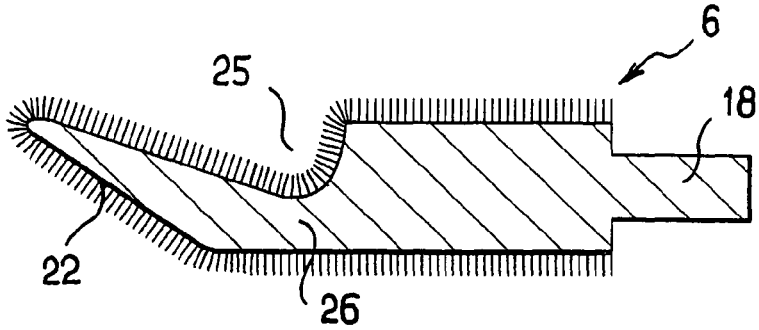

In the above-described embodiments, the bottom wall of the recess 25 may be quite angular. However, it is contemplated that the bottom wall may be rounded, for example, as illustrated in FIG. 13, in such a manner as to enable the composition that accumulates thereon to be applied more easily.

Figure 17:
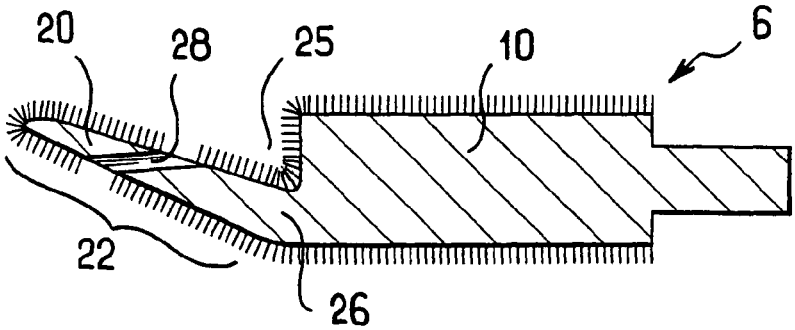

As illustrated in FIG. 17, the second portion 20 may include an opening, such as a slot 28, that is configured to enable the composition to flow between the recess 25 and the application face 22. Such a configuration may make it possible to apply a greater quantity of composition. For example, the slot 28 may be oriented substantially parallel to the longitudinal axis of the applicator endpiece.

Figure 24:
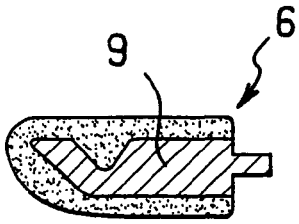
FIG. 24 is a longitudinal cross-sectional view of another exemplary applicator endpiece.

The body of the applicator endpiece may be covered completely by flocking, or only part of the endpiece may be covered by flocking, or the endpiece need not be covered by any flocking. In exemplary embodiments, the endpiece may be covered, at least in part, by foam, or may be covered completely by foam, as illustrated in FIG. 24, or, in exemplary embodiments, need not be covered by any foam.

In exemplary embodiments not illustrated, the body may include an outer surface that defines the application face.

Preferably, the body may not be made completely of foam. For example, the body may be different from a block of foam. For example, the body of the applicator endpiece need not be absorbent, and may be capable of compressing little, if at all.

The applicator endpiece may preferably be molded of a plastics material selected, for example, from: elastomers; thermoplastic materials; thermoplastic elastomers, for example thermoplastic elastomer polyester such as Hytrel®; nitrile rubber; silicone; EPDM; SEBS; SIS; PU; EVA; PVC; PE; PET; and PP.

The material from which the body 9 of the applicator endpiece 6 is made may preferably be more flexible than a material from which the stem 4 is made, so as to enable the body of the applicator endpiece to deform during application, for example, when the user presses the applicator gently against the surface to be made-up. In exemplary embodiments, the stem may include a flexible zone that is configured to enable even more flexibility to be brought to the application, for example, a hinge-forming zone.

The applicator endpiece may optionally include magnetic properties. For example, the body of the applicator endpiece may be made of a plastics material loaded with magnetic particles.

Figure 23:
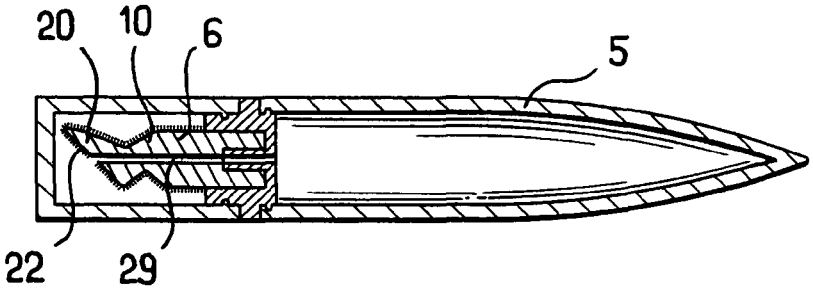
FIG. 23 is a longitudinal cross-sectional view of another exemplary device.

In the above-described embodiments, the applicator 3 may be dipped into a receptacle 2 containing the composition. However, it is contemplated that the applicator endpiece may be fastened to a receptacle that contains the composition for application, and that serves as a handle, as illustrated in FIG. 23.

The applicator endpiece 6 may be fastened to the neck of the receptacle. A channel 29 may pass through the body of the applicator endpiece 6, and may be configured to enable the composition to flow from the receptacle to the application face 22.

The applicator endpiece may be supplied with composition in some other way, for example, without a channel 29, the composition flowing around an outside of the applicator endpiece.

The invention is not limited to the exemplary embodiments described above. The characteristics of the various exemplary embodiments may be combined with one another in exemplary embodiments that are not shown.

The applicator endpiece in FIG. 23 may be replaced by any one of the applicator endpieces in FIGS. 10 to 16 or 24, with composition being supplied either internally or externally.

The expression "comprising a" should be understood as being synonymous with "comprising at least one", unless specified to the contrary.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A packaging and applicator device for applying a lip composition to lips, the device comprising:

a receptacle containing the lip composition;

an applicator for applying the lip composition to a surface, the applicator comprising:

at least one applicator endpiece comprising at least a body of non-porous material that is covered, at least in part, by flocking, the body comprising:

a proximal first portion;

a distal second portion connected to the first portion and comprising at least one application face; and at least one hinge-forming zone between the first portion and the second portion, the hinge-forming zone being configured to enable the second portion to pivot relative to the first portion while the application face is pressing against the surface, the at least one application face being substantially planar, and a pivot axis of the hinge-forming zone being substantially parallel to the at least one application face; and wherein the device further comprises a wiper member configured to wipe the applicator, and wherein the body comprises at least one recess forming the hinge-forming zone.

2. An applicator according to claim 1, wherein the body comprises two recesses.

3. An applicator according to claim 2, wherein the body comprises at least one side, and wherein the two recesses are situated on the side of the body.

4. An applicator according to claim 2, wherein the body comprises at least two opposite sides and wherein one of the two recesses is situated on a respective one of the two opposite sides of the body.

5. An applicator according to claim 2, wherein the two recesses together define a single hinge-forming zone.

6. An applicator according to claim 2, wherein each of the two recesses define a respective hinge-forming zone.

7. An applicator according to claim 1, wherein the body comprises at least two opposite lateral sides and wherein at least one recess opens to each of the two opposite lateral sides of the body.

8. An applicator according to claim 1, wherein at least one of the first and second portions includes a cross-sectional shape selected from: circular, oval, elliptical, polygonal, square, triangular, rectangular, pentagonal, and hexagonal.

9. An applicator according to claim 1, wherein the hinge-forming zone includes a cross-sectional shape selected from: circular, oval, elliptical, polygonal, square, triangular, rectangular, hexagonal, and pentagonal.

10. An applicator according to claim 1, wherein the hinge-forming zone includes a flat-shaped cross-section.

11. An applicator according to claim 1, wherein the hinge-forming zone includes shape memory.

12. An applicator according to claim 1, wherein the hinge-forming zone includes a cross-section that is inscribed in a largest cross-section of at least one of the first portion and the second portion.

13. An applicator according to claim 1, wherein a smallest cross-section of the hinge-forming zone is not greater than 2 $mm^2$.

14. An applicator according to claim 1, wherein the body is covered completely by flocking.

15. An applicator according to claim 1, wherein the body is covered, at least in part, by a porous material.

16. An applicator according to claim 1, wherein the body includes an outer surface that defines the application face.

17. An applicator according to claim 1, wherein the body of the applicator endpiece comprises, at least in part, a molded material selected from the following list: elastomers; thermoplastic materials; thermoplastic elastomers; thermoplastic elastomer polyester; nitrile rubber; silicone; EPDM; SEBS; SIS; PU; EVA; PVC; PE; PET; and PP.

18. An applicator according to claim 1, wherein the body of the applicator endpiece comprises a monolithically molded fastener portion configured to be fastened onto a remainder of the applicator.

19. An applicator according to claim 1, wherein the applicator endpiece is magnetic.

20. An applicator according to claim 1, further comprising a reserve of composition and a channel that passes through the body of the applicator endpiece, the channel being configured to enable the composition to flow from the reserve of composition to the application face.

21. An applicator according to claim 1, wherein the second portion is configured to pivot relative to the first portion substantially about a pivot axis that is perpendicular to a longitudinal axis of the applicator.

22. An applicator according to claim 21, wherein the longitudinal axis of the applicator and a longitudinal axis of the applicator endpiece define a plane that is substantially perpendicular to the pivot axis between the first and second portions.

23. An applicator according to claim 1, wherein the applicator endpiece extends generally along a longitudinal axis that forms a non-zero angle with a longitudinal axis of the applicator at rest.

24. An applicator according to claim 1, wherein the second portion comprises at least one opening configured to enable the composition to flow more easily between the at least one recess and the application face.

25. An applicator according to claim 24, further comprising a handle that is fastened to an end of a stem that is remote from the applicator endpiece.

26. An applicator according to claim 25, wherein the handle comprises at least one reception zone configured to receive a finger, the at least one reception zone extending substantially parallel to a pivot axis between the first and second portions.

27. An applicator according to claim 1, further comprising a stem including an end, the first portion of the applicator endpiece being fastened to the end of the stem.

28. An applicator according to claim 27, wherein the applicator endpiece is fastened to the stem by at least one of injection-molding onto the stem, adhesive, heat-sealing, force-fitting, snap-fastening, clamping, and screw-fastening.

29. An applicator according to claim 27, wherein the body of the applicator endpiece comprises, at least in part, a material that is more flexible than a material comprising the stem.

30. An applicator according to claim 1, wherein the first portion is fastened to the receptacle containing the lip composition.

31. A device according to claim 1, wherein the wiper member comprises an elastomer wiper lip.

32. A device according to claim 31, wherein the wiper lip comprises a material that does not include cells.

33. A device according to claim 1, wherein a smallest inside diameter of the wiper member is substantially equal to a greatest outside diameter of the at least one applicator endpiece.

34. A device according to claim 1, wherein the receptacle is closed in a leaktight manner.

35. A method of applying makeup to at least one lip of a user using an applicator endpiece comprising a body of non-porous material and comprising:

a proximal first portion;

a distal second portion connected to the first portion and comprising at least one application face; and at least one hinge-forming zone between the first portion and the second portion, the hinge-forming zone being provided by a recess of the body, the at least one application face being substantially planar, and a pivot axis of the hinge-forming zone being substantially parallel to the at least one application face, the method comprising:

exerting pressure on the at least one lip of the user sufficient to cause the second portion to pivot relative to the first portion.

36. A packaging and applicator device for applying a lip composition to lips, the device comprising:

a receptacle containing the lip composition;

an applicator for applying the lip composition to a surface, the applicator comprising:

at least one applicator endpiece comprising at least a body of non-porous material that is covered, at least in part, by flocking, the body comprising:

a proximal first portion;

a distal second portion connected to the first portion and comprising at least one application face; and at least one hinge-forming zone between the first portion and the second portion, the hinge-forming zone being configured to enable the second portion to pivot relative to the first portion while the application face is pressing against the surface; and wherein the device further comprises a wiper member configured to wipe the applicator, and wherein the body comprises at least one recess forming the hinge-forming zone and wherein the recess comprises a bottom that is connected to a remainder of a lateral surface of the applicator endpiece by at least one rectilinear edge.

37. A method according to claim 35, wherein the recess comprises a bottom that is connected to a remainder of a lateral surface of the applicator endpiece by at least one rectilinear edge.

* * * * *